United States Patent [19]

Mulcaster

[11] Patent Number: 4,795,151

[45] Date of Patent: Jan. 3, 1989

[54] BABY WALKER WITH SAFETY TRACK FEATURE

[76] Inventor: Donald L. Mulcaster, 359 Dennie Avenue, Newmarket, Ontario, Canada, L3Y 4M8

[21] Appl. No.: 103,178

[22] Filed: Sep. 30, 1987

[51] Int. Cl.[4] ..... A61H 3/00

[52] U.S. Cl. ..... 272/70.3

[58] Field of Search ..... 272/70, 70.3, 70 A, 272/70.4, 33 R, 33 A, 33 B; 104/53, 62, 118, 242, 248; 180/166

[56] References Cited

U.S. PATENT DOCUMENTS

| | | | |
|---|---|---|---|
| 280,442 | 7/1883 | Brown | 104/248 |
| 368,477 | 8/1887 | Lane et al. | 272/33 R |
| 592,569 | 10/1897 | Lehmann | 272/33 R |
| 596,342 | 12/1897 | Tinney | 104/248 |
| 642,435 | 1/1900 | Firnhuber | 104/62 |
| 671,058 | 4/1901 | Resetar | 272/33 R |
| 1,178,224 | 4/1916 | Gibbon | 104/248 |
| 1,297,018 | 3/1919 | Scott | 272/70.3 |
| 1,415,831 | 5/1922 | Federicks | 272/33 R |
| 1,437,179 | 11/1922 | Herson | 272/33 R |
| 2,308,626 | 1/1943 | Reinholz | 272/33 R |
| 2,352,450 | 6/1944 | Reinholz | 272/33 R |
| 2,505,310 | 4/1950 | Thompson | 248/163.1 |
| 2,527,460 | 10/1950 | Smith | 272/33 R |
| 2,746,517 | 5/1956 | Dahlberg | 272/33 R |
| 2,761,683 | 9/1956 | Stancliff | 104/53 X |
| 2,890,741 | 6/1959 | Reinholz | 272/33 R |
| 3,049,350 | 8/1962 | Walker | 272/33 R |
| 3,204,954 | 9/1965 | Scannell | 272/70.4 |
| 3,721,437 | 3/1973 | Skaricic | 272/70.3 |
| 3,796,430 | 3/1974 | Sudo | 272/70.3 |
| 4,537,577 | 8/1985 | Sansome et al. | 446/445 |
| 4,621,804 | 11/1986 | Mueller | 272/70.3 |

FOREIGN PATENT DOCUMENTS 1166856 10/1969 United Kingdom .

OTHER PUBLICATIONS

Popular Mechanics; 1/1959; pp. 214 and 215; by Overman: "Multipurpose Orthopedic Walker".

*Primary Examiner*—Richard J. Apley
*Assistant Examiner*—Howard Flaxman
*Attorney, Agent, or Firm*—Gordon W. Hueschen

[57] ABSTRACT

A novel baby walker with a safety track feature, involving cooperating and complementary track and securement device which secures said walker movably and rollably by the use of cooperating wheels, with respect to the track, is disclosed. The track comprises an upwardly-extending shaped protuberance for movable securement thereto of a complementary locking device on the walker and a relatively flat outwardly-extending portion or platform for contact with wheels associated with the locking device, so that the walker may be movably and removably secured to said track and moved along the track by the occupant of the vehicle with the wheels riding on the flat portion of said track on the one side and by wheels riding on the floor on the other side of said walker. In a preferred embodiment, spring-biased track lock-on levers having complementary track lock-on hook portions are provided for convenient attachment to and detachment from the track.

27 Claims, 3 Drawing Sheets

20
10
42
40
22
36
38
32
26
24
28
30
34
44
46
52
56
50
58
60
62
70
86
82
8.

62
82
74
70
64
80
84
9.
56
72

76
62
74
70
64
66
10.
78
68
56
72
12
13

60
64
62
66
70
78
68
62

60
64
62
78
70
68
66
62

Fig. 11.
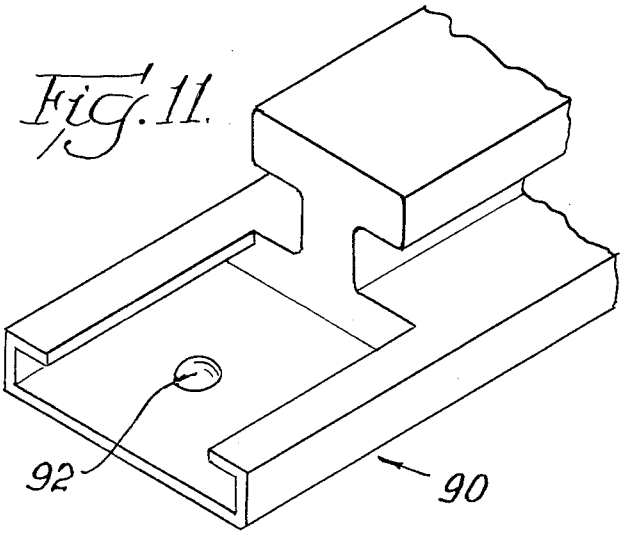
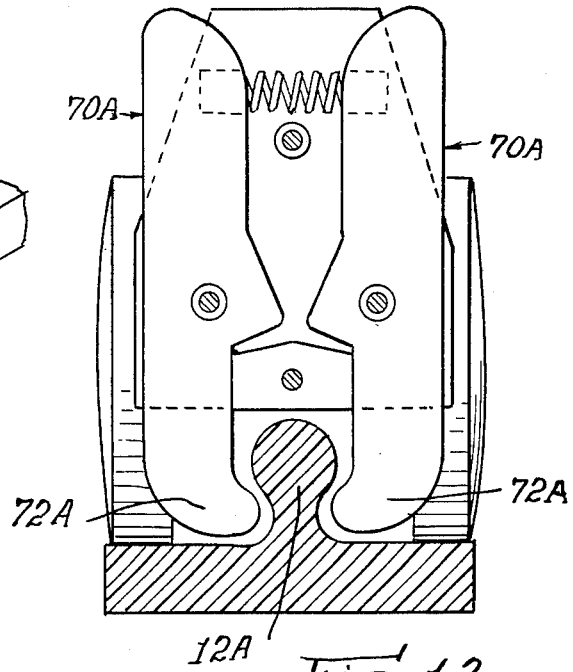
Fig. 13.
Fig. 12.
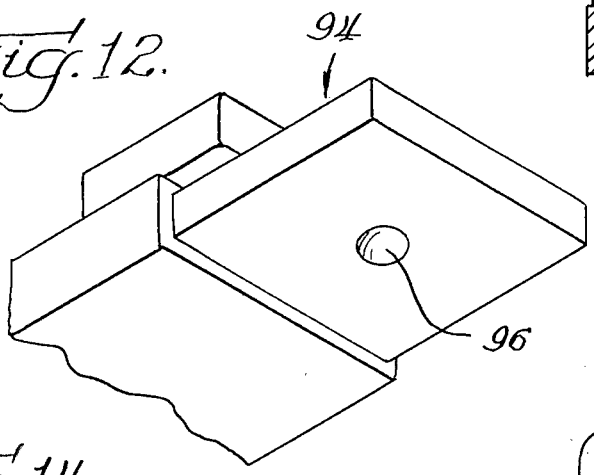
Fig. 14.
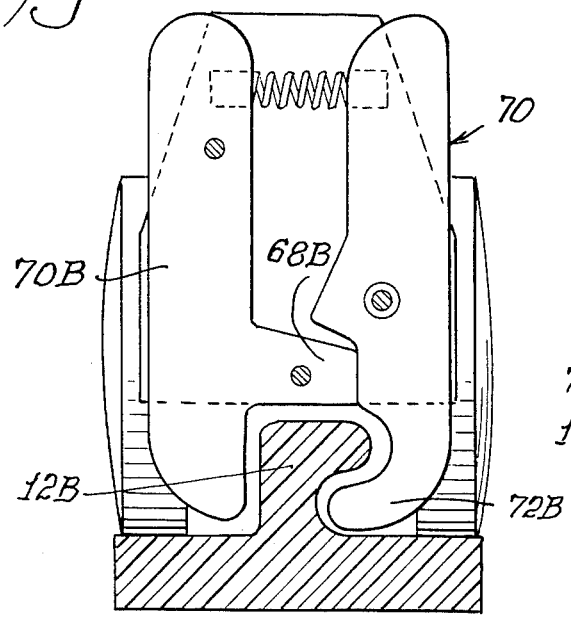
Fig. 15.
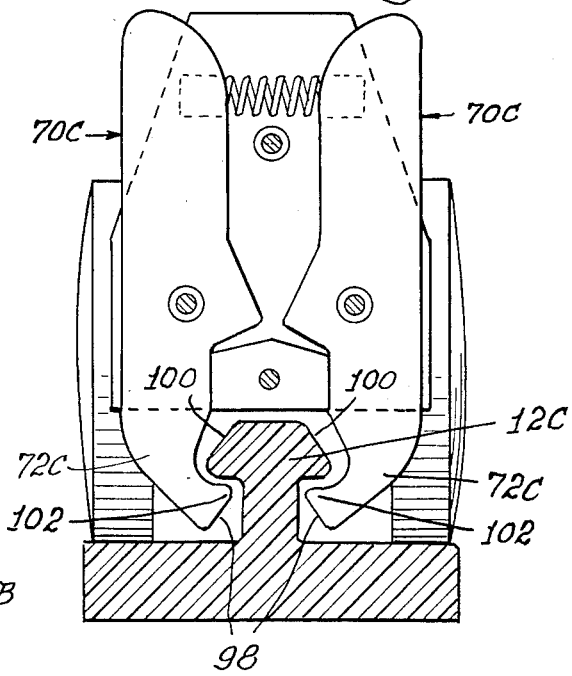

BABY WALKER WITH SAFETY TRACK FEATURE

BACKGROUND OF THE INVENTION

1. Field of Invention

Infant, baby, or "kiddie" walkers; such apparatus having improved safety features; such apparatus wherein safety features are provided in the form of a track and associated means on said baby walker for movably securing said baby walker thereto and thereby limiting the ambit of operation of the baby walker by its occupant without interfering with the acceptability or efficiency of such device.

2. Prior Art

Infant or baby walkers have been with us as long as the combination of babies, seats, and wheels have been available, and perhaps even before wheels. The concept of facilitating leg development while simultaneously somewhat restraining the child by means of such apparatus is uniformly recognized. Countless forms and modifications of baby walkers are presently available on the market and numerous versions have been patented. As representative may be mentioned U.S. Pat. Nos. 368,477 from 1887, 592,569 from 1897, 671,058 from 1901, 1,297,018 from 1919, 1,437,179 from 1922, and more recently U.S. Pat. Nos. 2,308,626, 2,352,450, 2,505,310, 2,746,517, 2,890,741, and 3,049,350. The desirability of incorporating safety features into devices of the class described has also been recognized. Representative patents in the field based upon the concept of improved safety include all of the foregoing plus British No. 1,166,856, published in 1969.

Fundamental to the concern of all parents or baby-tenders is the fear that a child in a baby walker will escape attention or supervision for a period sufficiently lengthy to enable the child to encounter objects, such as a protrusion, overhang, steps, or stairs, whereby serious physical damage could be and sometimes is caused to the child. One possible solution is to circumscribe the area of activity of the toddler in the baby walker and this problem has been solved to a greater or lesser extent by close supervision, clearing of a certain area for use by the toddler in the baby walker, or otherwise, such as by a restraining rope or cord, central standard plus grooved track, tether, or anchor, as indicated in the foregoing U.S. Patents, but to date no really efficient and satisfactory solution has been provided. The present invention addresses the circumscription of the ambit of operation of a baby walker by the occupant thereof in a most efficient and advantageous manner which has proved highly satisfactory, safe, and efficient in practice and whereby the long-felt needs of the prior art have been fulfilled and the shortcomings of the prior art overcome.

OBJECTS OF THE INVENTION

It is accordingly an object of the present invention to provide a combination of a baby walker and cooperating track means and means for movably securing said baby walker to said track for purposes of circumscribing the area of operation of said baby walker by the occupant thereof. An additional object of the invention is to provide an improved device of the class described having various improved-safety features, including convenient attachment and detachment means for securing said baby walker to said track, adaptability of said securement means for operation of said vehicle either inside or outside of said track as may be convenient or desirable, and ready securement of said vehicle to said track in a convenient, rapid, and facile manner. Still an additional object of the invention is the provision of the novel securement means themselves, as well as a track means having an essential shaped protuberance, preferably an upwardly-extending protuberance, and vehicle-securement means in the form of spring-biased chocks or blocks having a complementarily-shaped opening, whereby said blocks or chocks may movably engage the upwardly-extending shaped protuberance of said track and in turn be secured, preferably removably secured, to said vehicle, which vehicle is also preferably equipped with a plurality of wheels, ordinarily four (4) sets of wheels, two of which on the same side of said vehicle are preferably so located with respect to said track and to said blocks or chocks in which mounted so as to ride or roll upon an outward extension or platform provided as a part of said track. A still further object of the invention is the provision of such a device including such chocks in the form of casters which are adapted to be secured to the front and rear of said vehicle frame on the same side thereof and which moreover may be shaped so as to correspond to the front and the rear of a unitary object or subject, such as a dog, thereby to provide the visual effect of an elongated object, the front of which is secured to the front of said walker and the rear of which is secured to the rear of said walker as presented to the eye by the contours of said wheeled securement means or casters. Still a further object of the invention is the provision of an apparatus of the type described comprising wheels or other rolling means, adapted to ride on a relatively level platform or outward extension provided as a part of said track, and provided with axles journaled or otherwise mounted in said wheels and/or said blocks, chocks, or casters thereby providing a combination of rolling means and securement means for cooperative operation together with the complementary elements of said track means, said blocks or chocks or casters in turn being adapted to be removeably secured to said baby walker to provide positive moveable securement thereof to said track but additionally to secure the same in rollable relation thereto. Numerous other objects of the invention will become apparent hereinafter and still others will be obvious to one skilled in the art as the description proceeds.

BRIEF DESCRIPTION OF THE INVENTION

The present invention relates to a baby walker having a safety track feature as already briefly described in the foregoing under "OBJECTS OF THE INVENTION".

SUMMARY OF THE INVENTION

The invention then, in summary, comprises the following, inter alia:

A baby walker and cooperating track means, said track means having securement means thereon and said baby walker having complementary securement means thereon, whereby said baby walker can be moveably secured to said track means for circumscribing the area of operation thereof;

such apparatus wherein said walker comprises rolling means and complementary securement means and said track means comprises a shaped protuberance for movable securement thereto of said complementary securement means on said walker;

such apparatus wherein said track means comprises an upwardly-extending shaped protuberance and a relatively flat outwardly-extending portion and said walker comprises locking means for complementary but movable securement to the upwardly-extending shaped protuberance of said track means, and rolling means associated with said locking means adapted for rollable engagement with said flat portion of said track means;

such apparatus wherein said locking means comprises lock-on levers and means for urging said lock-on levers into locked-on movable securement of said walker to said track means;

such apparatus wherein said locking means comprises lock-on levers and means for urging said lock-on levers into locked-on movable but removable securement of said walker to said track means, such apparatus including means for counteracting said urging means for removing said walker from said track, such apparatus wherein said track means comprises an upwardly-extending protuberance having a recess on both sides thereof when viewed in cross-section, such apparatus wherein said track means comprises an upwardly-extending T-shaped portion when viewed in cross section, such apparatus wherein said walker comprises lock-on means in the form of lock-on levers having lower portions, at least one of which lower portions comprises a lock-on hook portion, which lower portions are spring-biased toward each other and which, when so spring biased, define an opening therebetween, which opening corresponds to the shape of said track protuberance for movable securement of said walker to said track, such apparatus including means for maintaining lock-on hook portions in close but spaced relation to said track protuberance, such apparatus wherein said means comprises a stopblock, such apparatus wherein said means comprises a protuberance on one of said lock-on levers, such apparatus wherein two levers are provided and both of said levers are movable, such apparatus wherein two levers are provided, only one of said levers being movable, the other being stationary, such apparatus wherein only one lock-on lever is movable and spring-biased into track-locking engagement with said track, such apparatus wherein said track means comprises an upwardly-extending protuberance having a recess on only one side thereof when viewed in cross-section, such apparatus including means for preventing excessive outward movement of lock-on hook portions, such apparatus wherein said means comprises a stopblock and a complementary projection on a lever comprising a hook portion, such apparatus wherein said stopblock and a lock-on hook portion have complementary camming surfaces, such apparatus wherein said lock-on means is provided in the form of tracking casters.

such appartus comprising a lower frame member as a part of said walker and tracking casters and securement means for securing said tracking casters thereto, such apparatus wherein both track lock-on means and rolling means are associated with said casters, such apparatus wherein said casters are secured to said lower frame member by means of caster pins, such apparatus wherein said caster pins are secured in apertures formed in said casters and are attached to the bottom of said lower frame member, such apparatus wherein said tracking casters are removably secured to said lower frame member by caster-securement means, such apparatus comprising tracking-caster securement means on both sides of said lower frame member so that said tracking casters are interchangeable from one side of said walker to the other side of said walker, such apparatus wherein casters on one side of said walker are tracking casters and wherein casters provided on the other side of said walker are non-tracking casters, such apparatus wherein casters provided on both sides of said walker are tracking casters, such apparatus wherein tracking casters are provided on the same side of said walker, one adapted to be a forward tracking caster and the other adapted to be a rearward tracking caster on the same side of said walker, such apparatus wherein a forward tracking caster is shaped as the front part of a unitary design whereas a rearward tracking caster on the same side of the walker is shaped as the rear part of said unitary design, and such apparatus comprising a lower frame member and an adjustable top member and wherein said top member is adjustable vertically with relation to said lower frame member by means of cooperating telescoping posts on said members and lock means for locking said posts with respect to each other.

Also, such apparatus wherein said track means comprises an anti-slide bottom, such apparatus wherein said track means comprises track sections having male and female ends for ready assembly and dissembly, and such apparatus wherein said male and female ends have cooperating male and female detents.

Moreover, a tracking caster adapted for movable but removable securement to a protuberance of track means and adapted for securement to a baby walker comprising locking means including lock-on levers and means for urging said lock-on levers into locked-on movable but removable securement to said track means, and comprising also rolling means associated with said locking means adapted for rollable engagement with a flat portion of said track means, such tracking caster comprising means for counteracting said urging means for assisting with removal of said walker from said track, such tracking caster comprising locking means in the form of lock-on levers, at least one of which has a lock-on hook portion, which are spring biased toward each other and which, when so spring biased, define an opening therebetween, which opening corresponds to the shape of said track protuberance for removable securement of said caster to said track, and finally such tracking caster including means for maintaining lock-on hook portions in close but spaced relation to said track protuberance.

BRIEF DESCRIPTION OF THE DRAWINGS

Attention is now directed to the drawings for a further understanding of the invention, wherein:

FIG. 4 is a top view of a large track layout suitable for a nursery or the like.

FIG. 11 is a detail view of a female end of a track section.

FIG. 12 is a detail view of a male end of a track section.

FIG. 13 is a view similar to FIG. 8 but of a modified form of the invention having a rod-like rail protuberance and corresponding or complementarily-shaped track-locking hooks at the ends of the track-locking levers.

FIG. 14 is another modification of the invention wherein only one track-locking lever is spring-biased, the other being stationary and the track protuberance having one flat side, and FIG. 15 is a further modification wherein the track protuberance has a flat top with tapered sides and wherein the track-locking levers have complementarily-shaped track-locking hooks at the ends thereof.

DETAILED DESCRIPTION OF THE INVENTION

Figure 1:
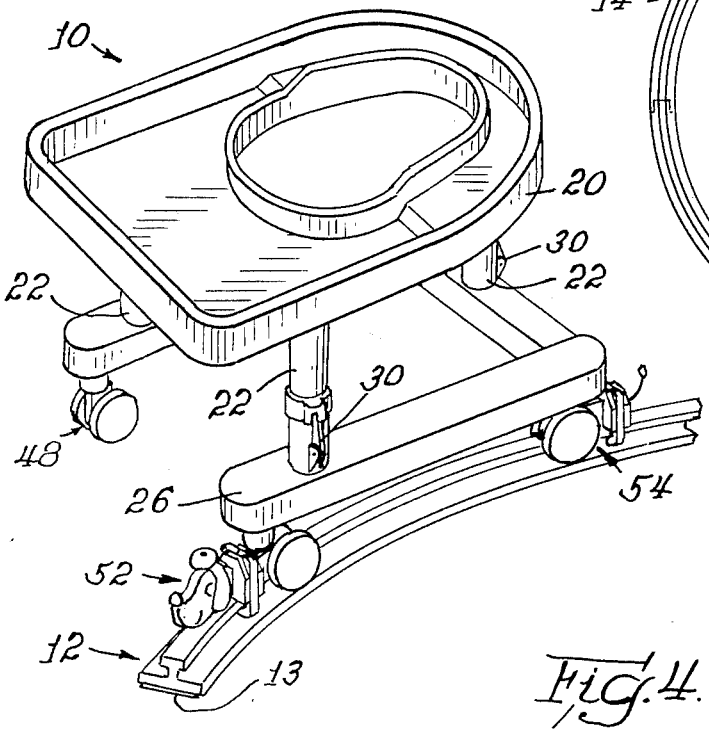
FIG. 1 is a perspective view of a child's walker locked on a track and traveling around the outer perimeter of the track.
Figure 2:
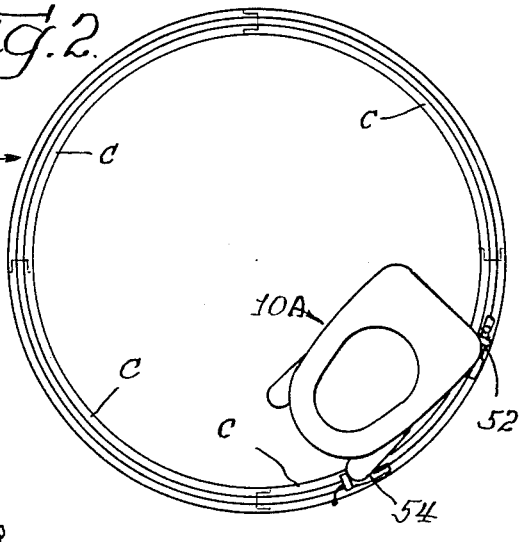
FIG. 2 is a top view of a circular track layout showing the walker on the inside of the track.
Figure 3:
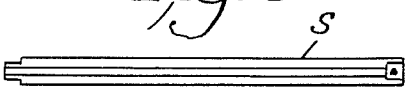
FIG. 3 is a top view of a straight-track section.
Figure 4:
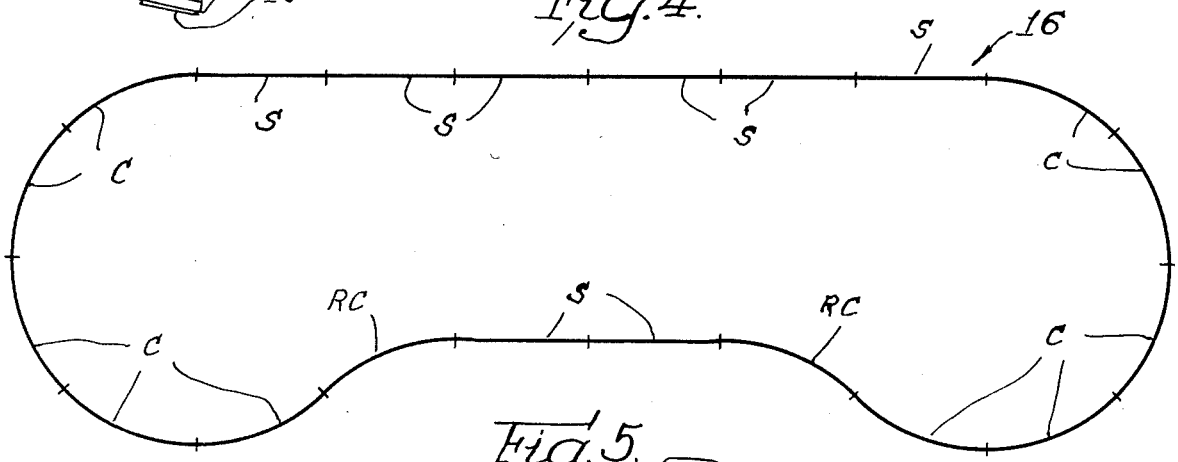
Figure 5:
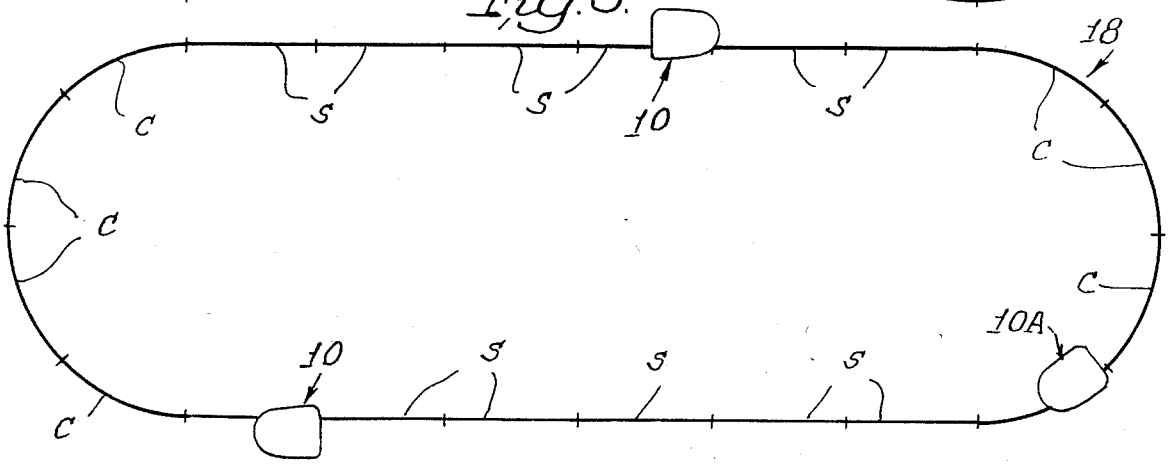
FIG. 5 is a top view of another large track layout schematically showing a plurality of baby walkers thereon, one traveling on the inside of the track and the other two traveling on the outside of the track.

Referring now to drawings, in which the same numbers refer to the same elements throughout, and wherein modifications to certain elements are indicated by the letters A, B, and C, there are illustrated various forms of the invention which comprises a baby walker and associated track means. In FIG. 1, the baby walker is shown generally at 10 and the associated track means is shown generally at 12. The track means has an associated anti-slide bottom 13 of any type, and a small circular track layout 14 of approximately four foot diameter is shown in FIG. 2. A larger track layout 16 of approximately eight foot diameter and suitable for a nursery or a large recreation or family room is shown in FIG. 4, whereas another large track layout 18 showing a plurality of tracking baby walkers 10 on a single track, with one walker 10A located on the inside of the track due to having its tracking casters on its outer side, is shown in FIG. 5. The tracks in these FIGS comprise curved track sections C, reverse curve sections RC, and straight track sections S. FIG. 3 is a top view of a single straight-track section.

Figure 6:
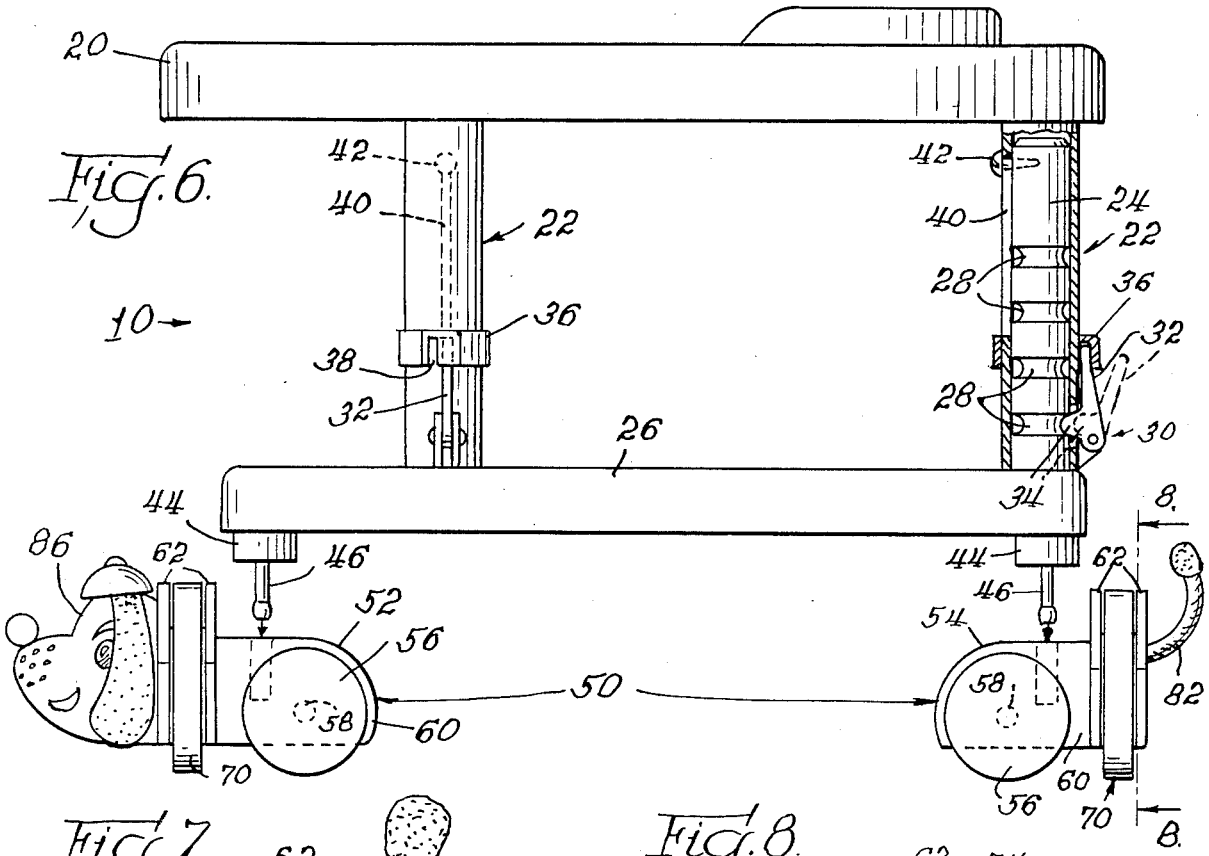
FIG. 6 is a side view of the walker with parts in section and the tracking casters pulled down off of the caster mounting pins.

It will be noted that, in FIG. 1, the walker 10 is on the outside of the track, whereas in FIG. 2 and in FIG. 5 walker 10A is on the inside of the track. The location of the walker with respect to the track is optional inasmuch as the tracking casters 50, as best seen in FIG. 6, are interchangeable with non-tracking casters 48, when all casters are not of the tracking caster 50 type, so that the tracking casters can be put on either the right side of the walker, as for 10A in FIG. 2 and FIG. 5, or on the left side as for walker 10 in FIGS. 1 and 5, to permit the child to proceed in either clockwise or counterclockwise manner on either the inside or the outside of any particular track layout, as may be desired.

At 20 is shown the upper portion of baby walker 10, which may as usual be equipped with restraining straps or slings to go under the baby's bottom or other such restraining or support means (not shown), supported by tubular posts or legs 22, as shown three (3) in number, which fit over corresponding vertical posts 24 in sliding relation thereto, the posts 24 being mounted on a lower frame 26.

Inner posts 24 comprise grooves 28 for height adjustment of the upper portion 20 according to size and growth to accommodate a particular child employing the walker. At 30 is shown a lock mechanism having a latch lever 32 with a lock knob 34 which fits into grooves 28 to maintain any set height of upper portion 20, said lever 32 being held in place in locked position by restraining means 36. By forcing lever 32 to the left, as viewed in FIG. 6 with relation to the front post 22, or by twisting restraining means 36 to the right, lever 32 can be cleared out or withdrawn through openings 38, as shown on back two posts 22 and 24, so that the upper portion 20 can be raised or lowered and latched into a different height position. Slot 40 in outer posts 22 limits the vertical movement of outer posts 22 with respect to inner posts 24 so that upper portion 20 can not be removed completely without removing screws 42 secured to inner posts 24 through said slot 40.

According to the dictionary definition of "caster", it is a wheel or set of wheels mounted in a frame free to swivel about an axis perpendicular to the axis of the wheel or set of wheels and useful for supporting various items. Accordingly, the units 50 can be considered to comprise dual-wheel track lock-on casters as can wheeled assemblies 48 on the other side of the walker 10 or 10A, which units 48 may or may not be identical to the tracking casters, i.e., the track lock-on caster units 50, and may or may not comprise track lock on mechanisms as previously indicated. Caster bearing bosses 44 are located on the four (4) corners of lower frame 26 and have caster pins 46 mounted therein for receiving wheel assemblies 48 on the one side, which may also be dual-wheel castes (as shown) but which are not necessarily such and which are not necessarily track lock-on casters, and for receiving dual-wheel track lock-on casters 50 on the other side of the walker 10, the latter preferably being of an attractive ornamental type. As shown, the forward tracking caster 52 is shaped as the forward part of a unitary design and the rearward tracking caster 54 of said walker is shaped as the rear portion of a unitary design, in this case the unitary design being that of a dog, that is, forward tracking caster 52 is shaped like the head of a dog and rearward tracking caster 54 is shaped like the rear of a dog. It will be apparent that a wide variety of unitary designs can be so devised or employed in the same manner, with the subject being, e.g., animal, fish, or fowl, or the front end of a train and the rear end of a train, e.g., a caboose, or the front end as a tractor and the rear end as a trailer, and so on, the exact type of unitary design being unimportant so long as front tracking caster 52 comprises the forward portion of the same and rearward tracking caster 54 is shaped to provide the rear portion of the same.

Caster pins 46 are removable or non-removable from their apertures as an optional feature, with removable securement being preferred, but in any event are received and secured in apertures in front and rear tracking casters 52 and 54, each having wheels 56 with axles 58 mounted through central bodies 60, each having a pair of plates 62 held together by screws 64 and spaced apart by sleeves 66 and stop-block 68. Sandwiched between plates 62 are track lock-on means comprising a pair of track lock-on levers 70 having at their lower extremities track lock-on hooks 72 for locking under the protruberance, as shown an upwardly-extending T-shaped protuberance, of the track 12, which is located centrally of the track, thereby permitting dual wheels 56 to ride upon the outwardly-extending platform or relatively flat portion of the track 12.

It is to be noted that rear caster 52 is reversed in that the wheels 56 are ahead of the pivot pin 46, so that the locking means 70 clears the lower frame 26, but this is not necessary when bearing bosses 44 have a sufficient length so that the track lock-on means 70 has a sufficient clearance under frame 26, the exact location of the members being optional.

Track lock-on levers 70 have finger- or hand-grip ends 74 which are spring-biased outwardly by urging or spring-biasing means, e.g., spring 76 or any equivalent "urging" or biasing means such as elastic, elastomeric or like urging or "spring-biasing" means, but limited in the extent of their outward bias by stop-block 68 so that track lock-on hooks 72 at the lower extremities of levers 70 are held in spaced relation to said track and to said T-shaped protuberance thereof to permit ready movement of the tracking casters along said track even though movably-secured thereto. Ends 74 provide means for overcoming this urging means when it is desired to remove the walker from the track.

Lock-on levers 70 have an inward projection 78 which limits the outward travel of the lower lock-on hooks 72 thereof by said projection 78 coming into contact with the top of stop-block 68.

Figure 7:
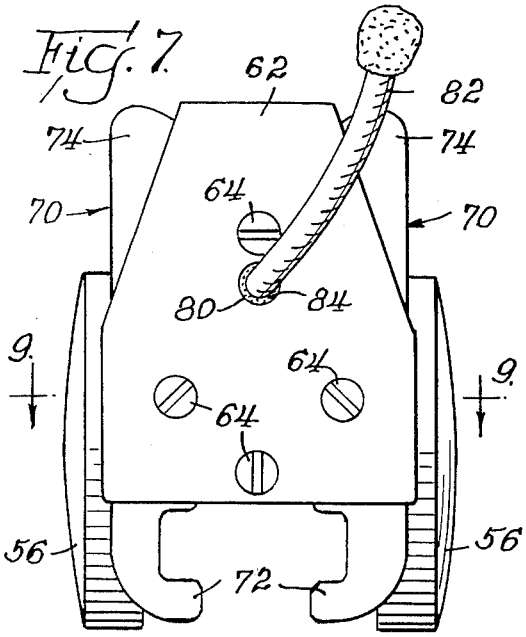
FIG. 7 is a back view of the rear tracking caster.
Figure 8:
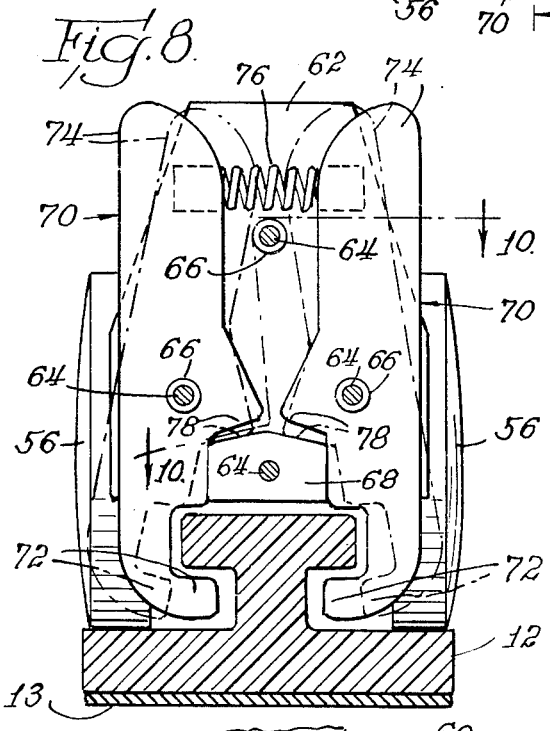
FIG. 8 is a section on FIG. 6 with the track added and showing the track-release position in dot-dash phantom lines.

On rearward tracking caster 54, rearwardmost plate 62 has an aperture 80 drilled therein for receiving flexible tail 82, so that the tail fits snugly into aperture 80 and is secured therein by the enlarged end 84 thereof (not shown) on the other side of plate 62 in FIG. 7.

Figure 9:
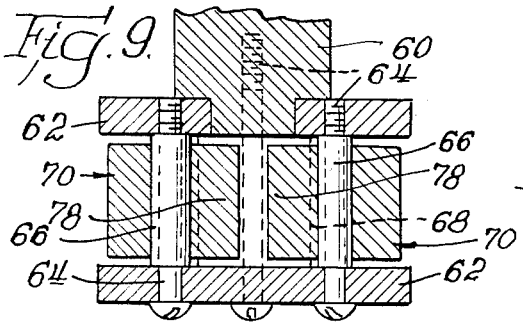
FIG. 9 is a section on FIG. 7.
Figure 10:
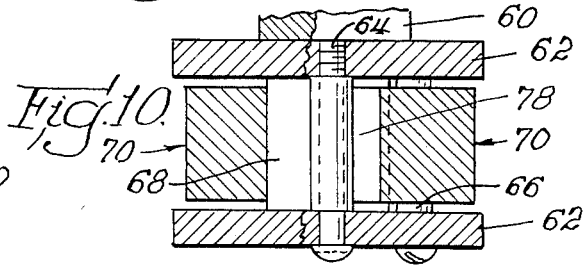
FIG. 10 is a section on FIG. 8 in which the section shown in dot-dash phantom lines is not to be confused with the release position shown in phantom lines for the levers 70 as shown in FIG. 8.

On forward tracking caster 52, head portion 86 is attached to one of the plates 62 by a mortise and tenon joint, as are central bodies 60 of casters 52 and 54, as shown in FIG. 9, and securely fixed in place by a screw and glue (not shown).

In FIG. 11 is shown a female end of a track section with convex detent knob 92 and upwardly-extending T-shaped protuberance, whereas in FIG. 12 is shown a male end of the complementary track section having concave detent depression 96, for convenient yet secure connection of track sections into a track layout such as shown in FIGS. 2, 4, and 5.

In FIG. 13 is shown a modified track 12A having a modified upwardly-extending protuberance in the form of a rod-like or continuous neck- and head-shaped member when viewed in cross section, with modified lock-on levers 70A having modified track lock-on hooks 72A at the lower extremities thereof, designed to lock onto a track having this type of upwardly-extending protuberance.

In FIG. 14 is shown another modified form of the invention in which the upwardly-extending protuberance of track 12B has one flat side and one recessed side, so that only a single spring-biased arm or lever 70 need be employed, the opposite arm or "lever" 70B in such case being stationary. As will be seen, the upper screw has been moved to the left and the pivot screw has been eliminated in this modification, and the stationary lever 70B has been made thicker so as to obviate the necessity of spacer sleeves around the screws employed. Moreover, this stationary arm or lever 70B includes in the same piece or unit a stop-block or protuberance 68B, performing the same function as in the previous embodiments but in this case only with respect to the single spring-biased track lock-on lever 70 and its lower track lock-on hook component 72B.

In FIG. 15 is shown a further modification of the invention in which the track 12C has an upwardly-extending protuberance with a flat top and downwardly-tapered sides 100, and in which the lock-on levers 70C have corresponding lower track lock-on hooks 72C with hook contours 102 which are designed and adapted to lock under the upwardly-extending protuberance and which comprise camming surfaces 98 which are complementarily slanted so as to cam open off of slanted surfaces 100 upon downward engagement of the track lock-on hooks 72C with the upward proturbance of track 12C. In this modification it is not necessary to squeeze the track lock-on levers 70C together to movably secure the walker to the track, inasmuch as it is only necessary to locate the tracking casters over the track and then press down to bring surfaces 98 into sliding engagement with surfaces 100, thus camming track lock-on hooks 72C outwardly until locked into position, whereafter they are spring biased inwardly so as to bring hook contours 102 and surfaces 98 under the outwardly-extending lower surfaces of upwardly-extending protuberance of track 12C. However, to remove the tracking casters from the track, it is again necessary to squeeze levers 70C so as to counteract the spring bias and enable them to be upwardly removed from the track to which the casters are movably secured.

The various elements of this inventive combination may be constructed of any suitable or appropriate material, such as wood, metal, or plastic, as will be apparent to one skilled in the art.

In conclusion, from the foregoing, it is apparent that the present invention provides a novel baby walker with a safety track feature, involving cooperating and complementary track and securement means which secures said walker movably, removably, and ordinarily rollably by means of cooperating wheels with respect to said track, as well as the novel track, securement means, and the combination thereof, all together providing a unique and practical approach to the problem of circumscribing the ambit of operation of the occupant of a baby walker, and having the foregoing enumerated characteristics and advantages.

It is to be understood that the invention is not to be limited to the exact details of operation, or to the exact structures and embodiments shown and described, as obvious modifications and equivalents will be apparent to one skilled in the art, and the invention is therefore to be limited only by the full scope which can be legally attributed to the appended claims.

I claim:

1. An exercise device for the contained movement of an infant comprising a baby walker and cooperating single-track floor-mounted track means, said track means having securement means thereon and said baby walker having rolling means on both sides thereof and complementary securement means thereon on at least one side thereof, whereby rolling means on the one side of said baby walker can be movably but removably secured to said track means for circumscribing the area of operation thereof, wherein said track means comprises an upwardly-extending shaped protuberance and a relatively flat outwardly-extending portion and said walker securement means comprises locking means for complementary but movable securement to the upwardly-extending shaped protuberance of said track means, rolling means on the same side of said walker as said locking means being adapted for rollable engagement with said flat portion of said track means, wherein said locking means comprises hand-operable lock-on levers and means for urging said lock-on levers into locked-on movable but removable securement of said walker to said track means, and including hand-operable means for counteracting said urging means for assisting with attachment of said walker to and removal of said walker from said track.

2. The apparatus of claim 1, wherein said track means comprises an upwardly extending protuberance having a recess on both sides thereof when viewed in cross-section.

3. The apparatus of claim 2, wherein said track means comprises an upwardly-extending T-shaped portion when viewed in cross section.

4. The apparatus of claim 1, wherein said lock-on means is in the form of hand-operable lock-on levers having lower portions, at least one of which lower portions comprises a lock-on hook portion, which lower portions are spring-biased toward each other and which, when so spring biased, define an opening therebetween, which opening corresponds to the shape of said track protuberance for movable securement of said walker to said track.

5. The apparatus of claim 4, including stopblock means for maintaining lock-on hook portions in close but spaced relation to said track protuberance.

6. The apparatus of claim 4, wherein said means comprises a protuberance on one of said lock-on levers.

7. The apparatus of claim 4, wherein two levers are provided and both of said levers are movable.

8. The apparatus of claim 4, wherein two levers are provided, only one of said levers being movable, the other being stationary.

9. The apparatus of claim 4, wherein only one lock-on lever is movable and spring-biased into track-locking engagement with said track.

10. The apparatus of claim 9, wherein said track means comprises an upwardly-extending protuberance having a recess on only one side thereof when viewed in cross-section.

11. The apparatus of claim 4, including means for preventing excessive outward movement of lock-on hook portions, said means comprising a stopblock and a complementary projection on a lever, which lever also comprises a hook portion.

12. The apparatus of claim 4, wherein said upwardly-extending protuberance and a lock-on hook portion have complementary camming surfaces.

13. The apparatus of claim 4, wherein said lock-on means is included in tracking casters.

14. The apparatus of claim 13, comprising a lower frame member as a part of said walker, and securement means for securing said tracking casters to said lower frame member.

15. The apparatus of claim 14, wherein both track lock-on means and rolling means are associated with said casters.

16. The apparatus of claim 15, wherein said casters are secured to said lower frame member by means of caster pins.

17. The apparatus of claim 16, wherein said caster pins are secured in apertures formed in said casters and are attached to the bottom of said lower frame member.

18. The apparatus of claim 17, wherein said tracking casters are removably secured to said lower frame member by caster-securement means.

19. The apparatus of claim 18, comprising tracking-caster securement means on both sides of said lower frame member so that said tracking casters are interchangeable from one side of said walker to the other side of said walker.

20. The apparatus of claim 14, wherein casters on one side of said walker are tracking casters and wherein casters provided on the other side of said walker are non-tracking casters.

21. The apparatus of claim 14, wherein casters provided on both sides of said walker are tracking casters.

22. The apparatus of claim 14, wherein tracking casters are provided on the same side of said walker, one adapted to be a forward tracking caster and the other adapted to be a rearward tracking caster on the same side of said walker.

23. The apparatus of claim 22, wherein a forward tracking caster is shaped as the front part of a unitary design whereas a rearward tracking caster on the same side of the walker is shaped as the rear part of said unitary design.

24. The apparatus of claim 14, comprising a lower frame member optionally comprising a seat member and an adjustable top member and wherein said top member is adjustable vertically with relation to said lower frame member by means of cooperating telescoping posts on said members and lock means for locking said posts with respect to each other.

25. The apparatus of claim 4, wherein said track means comprises an anti-slide bottom.

26. The apparatus of claim 4, wherein said track means comprises track sections having male and female ends for ready assembly and dissembly.

27. The apparatus of claim 26, wherein said male and female ends have cooperating male and female detents.

* * * * *